US012690647B2

(12) United States Patent
Bray

(10) Patent No.: US 12,690,647 B2
(45) Date of Patent: Jul. 28, 2026

(54) ZIP TAIL STOP

(71) Applicant: Patrick Stewart Bray, Hampshire (GB)

(72) Inventor: Patrick Stewart Bray, Hampshire (GB)

(73) Assignee: Patrick Stewart Bray, Hampshire (GB)

( * ) Notice: Subject to any disclaimer, the term of this patent is extended or adjusted under 35 U.S.C. 154(b) by 88 days.

(21) Appl. No.: 18/710,017

(22) PCT Filed: Nov. 7, 2022

(86) PCT No.: PCT/GB2022/052807
§ 371 (c)(1),
(2) Date: May 14, 2024

(87) PCT Pub. No.: WO2023/089299
PCT Pub. Date: May 25, 2023

(65) Prior Publication Data

US 2025/0009078 A1 Jan. 9, 2025

(30) Foreign Application Priority Data

Nov. 16, 2021 (GB) ..... 2116489

(51) Int. Cl.
*A44B 19/36* (2006.01)

(52) U.S. Cl.
CPC ..... *A44B 19/36* (2013.01)

(58) Field of Classification Search
CPC ..... A44B 19/38; A44B 19/36; A44B 19/388; A44B 19/24; A44B 19/32; A44D 2203/00; Y10T 24/2593
See application file for complete search history.

(56) References Cited

U.S. PATENT DOCUMENTS 2,792,610 A 5/1957 Erdmann
2,834,084 A * 5/1958 Morin ..... A44B 19/38 24/433

(Continued)

FOREIGN PATENT DOCUMENTS

CN 204032535 U 12/2014
CN 204670515 U 9/2015

(Continued)

OTHER PUBLICATIONS

WO-2009153885 English Machine Translation from Espacenet, 12 pages (Year: 2009).*

(Continued)

*Primary Examiner* — Jason W San
*Assistant Examiner* — Louis A Mercado
(74) *Attorney, Agent, or Firm* — Conley Rose, P.C.

(57) ABSTRACT

A tail stop arrangement (200) for a zip (100) includes a first tail stop (300) for attachment to a first zip tape (102), the first tail stop (300) including a body (302) including a channel (304) and a second tail stop (400) for attachment to a second zip tape (104), the second tail stop (400) including a protrusion (406). The body (302) of the first tail stop (300) has a longitudinal axis and the channel (304) extends parallel to the longitudinal axis. A coordinate system of the tail stop arrangement (300) includes a y-direction parallel to the longitudinal axis, an x-direction perpendicular to the longitudinal axis along which the channel (304) is open and a z-direction perpendicular to the longitudinal axis along which the channel (304) is closed. The protrusion (406) is configured to be inserted into the channel (304) in the x-direction to engage the first and second tail stops (300, 400). The protrusion (406) is configured to slide within the channel (304) in the y-direction when the first and second tail stops (300, 400) are engaged, wherein the protrusion (Continued)

(406) is configured to slide in the channel (304) towards an end position. When the protrusion (406) is in the end position the first and second tail stops (300, 400) are aligned by the engagement of the protrusion (406) with the channel (304) in the x-, y- and z-directions to enable the zip (100) to be fastened.

15 Claims, 10 Drawing Sheets

(56) References Cited

U.S. PATENT DOCUMENTS

| | | | | |
|---|---|---|---|---|
| 4,221,026 | A * | 9/1980 | Kanzaka | A44B 19/38 24/433 |
| 5,608,952 | A | 3/1997 | Wilder | |
| 6,026,547 | A | 2/2000 | O'Donnell Kiely | |
| 7,882,602 | B2 * | 2/2011 | Himi | A44B 19/38 24/433 |
| 8,910,352 | B2 * | 12/2014 | Nozaki | A44B 19/26 24/433 |
| 9,027,210 | B2 * | 5/2015 | Peters | A44B 19/388 24/433 |
| D913,844 | S * | 3/2021 | Hung | D11/221 |
| 2013/0061436 | A1 | 3/2013 | Peters et al. | |
| 2018/0092442 | A1 | 4/2018 | Ogura | |

FOREIGN PATENT DOCUMENTS

| | | | | |
|---|---|---|---|---|
| CN | 210809540 | U | 6/2020 | |
| CN | 112914205 | A | 6/2021 | |
| FR | 2312986 | A1 | 12/1976 | |
| GB | 1528667 | A | 10/1978 | |
| WO | WO-2009153885 | A1 * | 12/2009 | A44B 19/38 |
| WO | 2021048930 | A1 | 3/2021 | |

OTHER PUBLICATIONS

UK Intellectual Property Office Search Report, dated May 11, 2022, 1 page.
Material District, Magnetic Zipper, dated Jul. 30, 2018, 2 pages.
YKK, Vislon® magnet type, dated Apr. 16, 2021, 3 pages.

* cited by examiner

ZIP TAIL STOP

CROSS-REFERENCE TO RELATED APPLICATIONS

This is a national stage of Int'l Patent App. No. PCT/GB2022/052807 filed on Nov. 7, 2022, which claims priority to G.B. Patent App. No. 2116489.2 filed on Nov. 16, 2021, both of which are incorporated by reference.

TECHNICAL FIELD

The present invention relates to a tail stop arrangement for a zip and a zip.

BACKGROUND

Zips are used as closures on clothing and life preservers for example, to bind two edges together. Zips are typically opened and closed by pulling a slider along two sets of teeth, which are brought together at one end in which a male zipping part is inserted into a female zipping part.

This manoeuvre may be difficult or even extremely difficult to perform for some people with lowered visual acuity or impairment and dexterity caused by a range of medical conditions such as a stroke, Parkinson's Disease, rheumatoid arthritis and other neurological conditions.

In addition, young children fail to be able to use a zip easily. Further, in extreme weather conditions where wearing gloves is required, users experience extreme difficulties.

Zips are notoriously difficult to fasten on someone else's clothing whether or not the person is young, old or disabled in some way.

If the male and female zipping parts are not aligned correctly, the zipping process fails.

Zips were invented in the 1900's and there is a definite need to improve the design for a universal use to benefit everyone.

SUMMARY

An aspect of the present invention provides a tail stop arrangement for a zip, comprising:

a first tail stop for attachment to a first zip tape, the first tail stop comprising a body comprising a channel; and a second tail stop for attachment to a second zip tape, the second tail stop comprising a protrusion, wherein the body of the first tail stop has a longitudinal axis and the channel extends parallel to the longitudinal axis, a coordinate system of the tail stop arrangement comprises a y-direction parallel to the longitudinal axis, an x-direction perpendicular to the longitudinal axis along which the channel is open and a z-direction perpendicular to the longitudinal axis along which the channel is closed, wherein the protrusion is configured to be inserted into the channel in the x-direction to engage the first and second tail stops and wherein the protrusion is configured to slide within the channel in the y-direction when the first and second tail stops are engaged, wherein the protrusion is configured to slide in the channel towards an end position, and wherein when the protrusion is in the end position the first and second tail stops are aligned by the engagement of the protrusion with the channel in the x-, y- and z-directions to enable the zip to be fastened.

Another aspect of the present invention provides a zip comprising:

a first zip tape comprising a first set of teeth;

a second zip tape comprising a second set of teeth configured to engage the first set of teeth;

a slider arranged on the first set of teeth, configured to slide along the first set of teeth and guide the second set of teeth into engagement with the first set of teeth; and the tail stop arrangement;

wherein the first zip tape comprises the first tail stop and wherein the second zip tape comprises the second tail stop and wherein the y-direction is parallel to the direction in which the slider is configured to slide on the teeth.

"Separating" zips are those in which the two edges can be completely separated when the zip is open. Tail stops are arranged at the end where the slider sits when the zip is open, the end which includes male and female parts that bring the two sides of the zip together. The female part is referred to as a 'box' and the male part is an 'insertion pin' in the present description. Top stops may also be provided at the other end of the teeth, to prevent the slider from coming off the teeth at the other end.

The zip tape is a strip of fabric including the teeth. The fabric may be sewn, glued or otherwise incorporated into a garment or whatever item includes the zip. The slider may be configured to interdigitate the teeth from each part of the zip (each zip tape). The slider may be arranged to slide on one of the sets of teeth whether the zip is open or closed. To close the zip, the other set of teeth also need to engage the slider. The slider may include a Y-shaped channel and may be mounted on the first zip tape via one side of the Y-shape. The second set of teeth may include the insertion pin configured to be inserted into the vacant side of the Y-shape. The insertion pin may be passed through the Y-shape and inserted into the box on the first zip tape. From this point, sliding the slider along both sets of teeth interdigitates them due to the Y-shaped channel. By using the present tail stops, it is easier for the user to get the insertion pin into the box. The box may be configured to receive the insertion pin. A stop for the insertion pin may be included inside the box (as part of the box), configured to engage the insertion pin when inserted properly into the box.

In use, the user may bring the two tail stops together in the x-direction first. Once brought together in the x-direction, the user may slide the second tail stop with respect to the first tail stop in the y-direction with the protrusion in the channel.

The protrusion's end position may be a point in the channel furthest away from the teeth. If the teeth are arranged near the top of the tail stops, the end position is closer to the bottom of the tail stops. As the protrusion slides to its end position, the tail stops may be brought together in both the y- and z-directions.

Once the tail stops are aligned in the x-, y- and z-directions, it may be possible for the user to fasten the zip successfully—i.e. without the slider getting stuck on misaligned teeth.

The protrusion may comprise a chamfered edge for improving the ease of engagement between the protrusion and the channel. The chamfer may include a smooth edge to enable smooth sliding in the channel. The protrusion may comprise multiple chamfered edges to enable smooth sliding in either direction in the channel.

The channel may narrow towards the end position, so that the accuracy of alignment between the first tail stop and the second tail stop in the z-direction at the end position is improved as the protrusion is moved towards the end position.

In prior art zips, having the insertion pin and box at the tail stops, the user needs to align the insertion pin with the box in both the x- and z-direction before insertion of the insertion pin into the box in the y-direction. In this case (as the coordinates cannot be defined with respect to the channel of the first tail stop), the y-direction is parallel with a longitudinal axis of the zip tape and sets of teeth and the x- and z-directions are both perpendicular directions. Using the present tail stop arrangement, the accuracy of alignment in the z-direction need not be high for the user to begin the zipping process. The insertion pin is guided into the box as the protrusion slides in the channel towards the end point, which also brings the tail stops into alignment in z.

The first tail stop may comprise a first part and a second part that are configured to be clamped around the first zip tape, and the first part and the second part together define the channel. This may facilitate simple assembly of the zip. The first tail stop may comprise claws configured to pierce the first zip tape.

The second tail stop may further comprise a channel parallel to a longitudinal axis of the second tail stop, wherein the protrusion is arranged in the channel and is configured to project from the channel, wherein the channel is configured to receive zip elements associated with the first zip tape in use. For example, the channel in the second tail stop may be sized to receive the slider such that when the user is bringing the first and second tail stops together, they are not hindered by the slider. The channel in the second tail stop may account for the slider while the user is aligning the first and second tail stops.

The second tail stop may comprise a third part and a fourth part that are configured to be clamped around the second zip tape, and the third part and the fourth part together define the channel. This may facilitate simple assembly of the zip. The second tail stop may comprise claws configured to pierce the second zip tape.

The third part and the fourth part may each comprise a portion of the protrusion. When brought together to clamp the second zip tape, this may also bring the portions of the protrusion together to form the protrusion. Alternatively, the protrusion may be arranged on one of the third or fourth parts.

The first and second tail stops may be formed from polymeric material. For example, the first and second tail stops may include a plastics material.

Alternatively, the first and second tail stops may include metal. In one example, one of the first and second tail stops may comprise a ferromagnetic material and the other of the first and second tail stops may comprise a permanent magnet. The permanent magnet may be configured to attract the ferromagnetic material magnetically to bring the first and second tail stops together.

In one example, both the first and second tail stops may comprise a permanent magnet configured to attract one another magnetically and bring the first and second tail stops together.

The second tail stop may comprise the permanent magnet and the magnet may be arranged on or within the protrusion. The channel in the first tail stop may include a ferromagnetic material and/or a magnet and the protrusion may be magnetically attracted towards the channel. The protrusion may comprise a chamfered edge and the permanent magnet may be arranged adjacent the chamfered edge.

The first tail stop and the second tail stop may each have an outer surface for grasping by a user, wherein when the protrusion is at the end position and the tail stops are aligned in the x-, y- and z-directions, the smooth outer surfaces may be parallel. Especially where the user is visually impaired or blind, the user may rely on touch the identify that the tail stops—and therefore the insertion pin and box—are aligned. The tail stops may be configured such that the outer surfaces of each sit parallel, forming a single outer surface, once the protrusion is in its end position.

The first zip tape may comprise the box (which may be adjacent the first set of teeth and configured to retain the slider on the first set of teeth). The channel of the first tail stop may be configured to receive the box. The channel of the first tail stop may extend away from the box along a length of the first tail stop, in the y-direction.

The first tail stop may clamp to the first zip tape adjacent the box.

In examples, the first tail stop may comprise the box, configured to retain the slider on the first set of teeth. The box may also be configured to ensure that when the insertion pin is inserted properly, the second set of teeth is properly aligned with the first set of teeth for closure. The box may also be configured to ensure the slider is correctly positioned on the first set of teeth to ensure correct matching of the first set of teeth with the second set of teeth when they are brought together. The box may also be configured to prevent the ends of the zip from bursting apart under load.

The second zip tape may comprise the insertion pin, configured to be inserted into the box through the slider to engage the slider with the second set of teeth.

In examples, the first tail stop may comprise a groove and the insertion pin may be configured to be inserted into the groove through the slider to engage the slider with the second set of teeth. The groove may include a stop for the insertion pin, configured to engage the insertion pin when it is inserted properly into the groove. In this example, the groove may replace the need for a box.

The zip may comprise a latching arrangement, wherein the first tail stop comprises a latch configured to latch onto a latch receiving element of the second tail stop, wherein the latching arrangement is configured to retain the first and second tail stops in the x-direction to prevent them from bursting apart under load.

The second tail stop may comprise a channel and the insertion pin may be arranged in the channel of the second tail stop. Part of the second zip tape may be arranged in the channel and the insertion pin may be attached to the second zip tape in a manner allowing the insertion pin to move around on the second zip tape (a fabric) within the channel. This flexibility may make it easier for the user to insert the insertion pin into the box. The channel may make allowances for the user misaligning the first and second tail stops when trying to insert the insertion pin into the box.

When the protrusion is in the end position, the insertion pin may be inserted into the box. This is because when the protrusion is in the end position, the first and second tail stops may be brought into alignment in x, y and z. Aligning the first and second tail stops in the y-direction may bring the insertion pin into the box.

The second tail stop may comprise a recess closer to the second zip tape than the protrusion, configured to receive the slider. The recess may make allowances for the user struggling to align the first and second tail stops in the x- and z-directions and getting the protrusion into the channel of the first tail stop. The user can attempt to insert the protrusion correctly without banging the body of the second tail stop on the slider (and potentially damaging the zip or getting it stuck).

The slider may comprise a tab configured to allow a user to move the slider on the teeth and wherein the recess has a length longer than a length of the tab. When the slider and tab are at the tail stop end of the second zip tape, the recess may make it easier for the user to grasp the tab. In particular where the zip is used on cold weather clothing such that the user may be operating the zip wearing gloves or mittens, making it easier to grasp the tab is desirable.

The first and second tail stops may extend a length from the respective first and second zip tapes of less than 0.1 m. The tail stops may extend a length from the respective zip tapes 0.08 m, for example, or 0.07 m or 0.06 m, 0.05 m or less than 0.05 m. Each tail stop may have a length of less than 0.1 m, for example 0.08 m, or less than 0.05 m for example. This may minimise how noticeably different the present zip is from a conventional zip. A benefit of the present zip may be that a user of a product including the zip may feel the effects of the improved first and second tail stops without noticing an aesthetic difference, difference in weight of the product, or the like.

DETAILED DESCRIPTION

Figure 1:
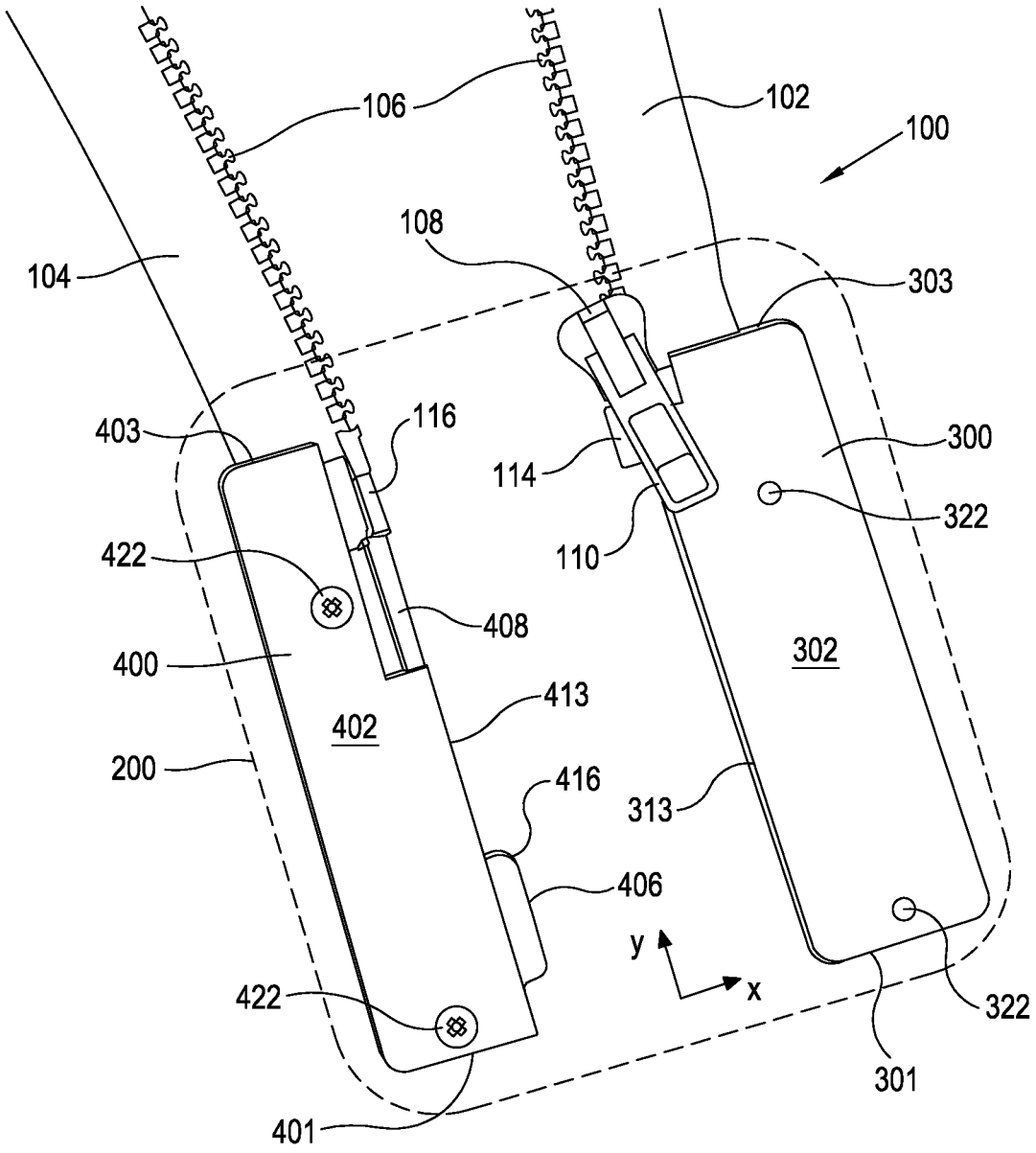
FIG. 1 shows a front view of a zip including a tail stop arrangement comprising a first tail stop and a second tail stop, with the zip separated, before engagement of the first tail stop with the second tail stop.

Embodiments of the present disclosure are described by way of example in more detail below. Terms such as horizontal, vertical, upper and lower should be understood as referring to relative positions and directions, since embodiments of the invention can be oriented arbitrarily (in any direction).

Referring to FIGS. 1 to 5, a zip 100 is shown including a tail stop arrangement 200. The tail stop arrangement 200 comprises a first tail stop 300 and a second tail stop 400. The first tail stop 300 is attached to a first zip tape 102 and the second tail stop 400 is attached to a second zip tape 104. The zip tapes 102, 104 each comprise a set of teeth 106 that are configured to interdigitate to close the zip 100. The teeth 106 are brought together and separated by a slider 108. In order to interdigitate the teeth 106 and fasten the zip 100, the insertion pin 116 must be fully inserted into the box 114 through the slider 108. Following this, moving the slider 108 up the zip tapes 102, 104 will interdigitate the teeth 106 and fasten the zip 100.

Inserting the insertion pin 116 into the box 114 is often difficult, because the pin 116 is relatively small, and the alignment of the pin 116 with the box 114 must be relatively precise in order to properly engage. The slider 108 is provided with a tab 110 for a user to clasp and use to pull the slider 108 along the teeth 106.

According to an embodiment, the process of inserting the pin 116 into the box 114 is simplified and guided using the tail stop arrangement 200.

The first tail stop 300 comprises a body 302. In this embodiment the body 302 comprises a first part 311 and second part 312 which are clamped about the first zip tape 102. The first part 311 may be secured to the second part 312 using fasteners such as screws 322, or any other suitable method (e.g. a snap fit or using an adhesive).

A channel 304 is defined in the body 302. The channel 304 defines a y direction along its length and an x direction, perpendicular to the y direction, along which the channel 304 is open. FIG. 1 depicts the x and y directions. A z direction is defined perpendicular to both x and y directions (out of the page in FIG. 1). The y direction corresponds with the direction that the slider 108 moves in order to fasten and unfasten the zip 100. For a front zip of a coat positioned at the front of the body when worn, the y direction is vertical, the x direction is horizontal and extends in the medial/lateral direction, and the z direction is horizontal and extends in the anterior/posterior direction.

A benefit of the tail stop arrangement 200 is that the user may bring the tail stops 300, 400 together with comparatively inefficient (or inaccurate) alignment in the z direction and still achieve proper alignment for the zip 100 to be closed, because the tail stops 300, 400 are configured to ensure alignment in the x and y directions that naturally cause subsequent alignment in the z direction.

The zip tape 102 fixed to the first tail stop 300 is positioned with the box 114 near an upper end 303 of the first tail stop 300. The channel 304 in the first tail stop 300 may be open at the upper end 303 of the first tail stop 300, and closed near the lower end 301 of the first tail stop 300 so as to define an end stop 305.

The body 302 further comprises a face 313, which contacts the second tail stop 400 to define the relative positions of the first tail stop 300 and the second tail stop 400 in the x direction.

The channel 304 may extend over at least half the length of the body 302 (in the y direction), for example, three quarters of the length. The channel 304 may be positioned centrally (in the z direction) as depicted in the example embodiment, but this is not essential.

The second tail stop 400 comprises a body 402, a lower end 401, and an upper end 403. The body 402 may include at least two pieces (shown as a third part 411 and a fourth part 412) configured to be brought together to form the body 402. This may allow the body 402 to be clamped about the second zip tape 104 (with the third part and fourth part clamped either side of the zip tape 104). FIG. 1 shows a pair of screws 422 through the body 402 securing the third part to the fourth part. Other suitable fixtures may be used, for example an adhesive, to form the body 402.

The second tail stop 400 further comprises a protrusion 406 and a channel 404. The protrusion 406 extends in the x direction outward from a face 413 of the second tail stop 400. The protrusion 406 is configured to be received in the channel 304 of the first tail stop 300, thereby constraining the relative positions (in the z direction) of the first tail stop 300 and second tail stop 400. The engagement between the face 313 of the first tail stop 300 and the face 413 of the second tail stop 400 constrain the relative positions of the first tail stop 300 and the second tail stop 400 in the x direction. The protrusion 406 and the faces 313, 413 guide the engagement between the first and second tail stop 300, 400 and the first and second zip tapes 102, 104.

The protrusion 406 is also configured to constrain the relative angular positions of the first tail stop 300 and the second tail stop 400 when the protrusion 406 is received in the channel 304. For example, the protrusion 406 may comprise a flat ridge that is configured to be received in the channel 304 so as to constrain relative rotation of the first tail stop 300 and the second tail stop 400 about the x axis. The protrusion may have a flat upper face and a parallel and flat lower face, and may be configured to provide a clearance fit with corresponding faces of the channel 304.

The tail stops 300, 400 may each have a width in the x direction at their ends 300*a*, 400*a*. The width of the first and second tail stops may be around 2.5 cm, for example within the range 1 cm to 3 cm. The length of the first and second tail stops may be in the range 1 cm to 105 cm. The widths (and/or lengths) of the first tail stop 300 and the second tail stop 400 do not have to be the same. The width of each body 302, 402 may vary along the longitudinal axis of each body 302, 402. The length of the protrusion 406 (in the y direction) may be between 5 mm and 35 mm. The thickness of the protrusion 406 (in the z direction) may be 0.5 mm to 15 mm. The protrusion 406 may stand out from the face 413 by at least 1 mm, for example between 1 mm and 5 mm (in the x direction). The clearance between the protrusion 406 and the channel 304 may be at least 20 microns, and may be at least 50 microns (in the z direction).

Figure 2:
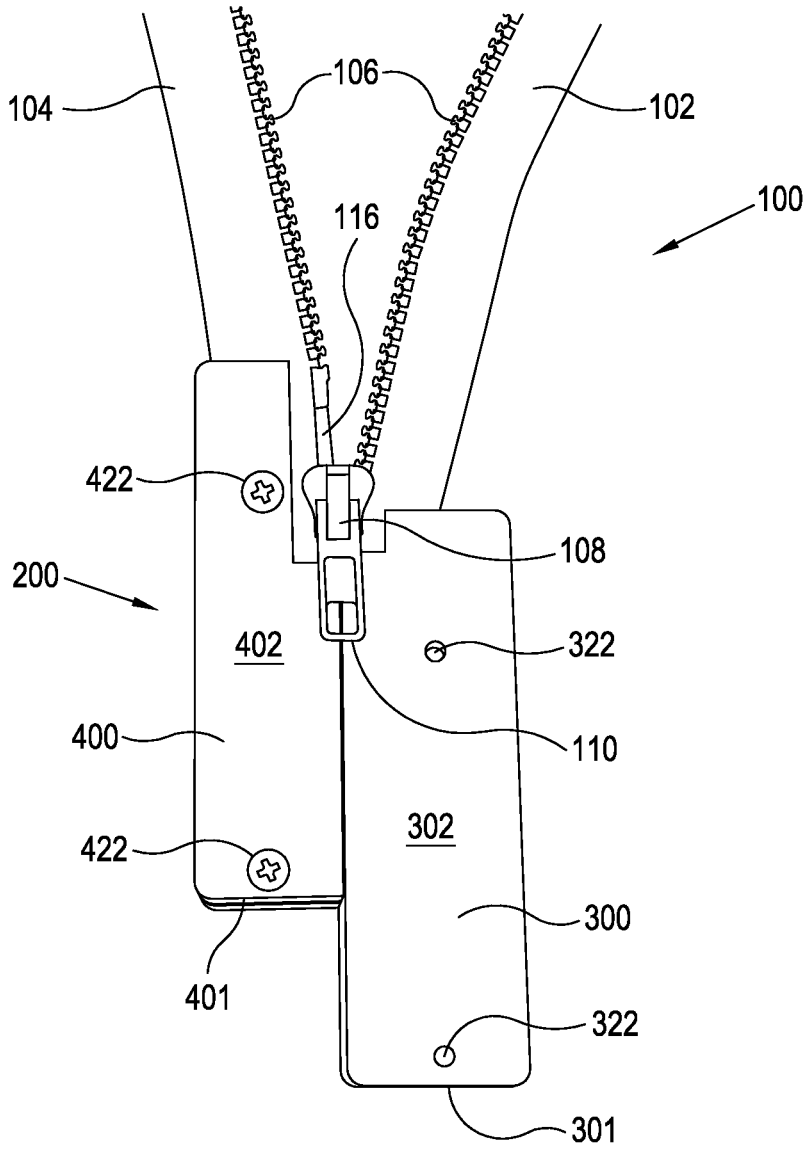
FIG. 2 shows a front view of the tail stop arrangement of FIG. 1, with the first tail stop and second tail stop engaged, but with the zip not yet engaged.

The channel 404 of the second tail stop 400 may be configured to accommodate the box 114 of the first zip tape 102 during engagement of the first and second tail stops 300, 400, as shown in FIG. 2. The box 114 may be received in the channel 404 of the second tail stop 400 as the protrusion 406 of the second tail stop 400 is received in the channel 304 of the first tail stop 300 (when the faces 313, 413 are parallel).

The second tail stop 400 further comprises a recess 408, for receiving the slider 108 of the first zip tape 102 as the first and second tail stop 300, 400 are brought into engagement. The recess 408 may comprise a region of the channel 404 in the second tail stop 400 that is open in the z direction. The recess 408 may also make the tab 110 easier to grasp for a user, with the recess allowing space for the user's fingers to get to the tab 110. The recess 408 may have a length longer than the tab 110, to aid the user in grasping the tab 110.

A removeable fastening means (such as screws 422) may be used such that the bodies 302, 402 are configured to be removably attachable to the zip tapes 102, 104. As such, the same bodies 102, 104 may be re-used with new zip tapes 102, 104. In other embodiments, the fastening of the bodies 302, 402 may be designed to be permanent.

In other embodiments one or more of the bodies 302, 402 may comprise a single part. For example, the body 302, 402 may comprise a flexible hinge along one side and a snap closing arrangement allowing it to be fastened (and optionally clamped about) about a zip tape 102, 104.

On or more of the bodies 302, 402 may include barbs or hooks, for example, for attaching to or even piercing the zip tape 102, 104. One or both of the bodies 302, 402 may include a recess for receiving the respective zip tape 102, 104.

Each body 302, 402 may be formed from a polymeric material or a metal, for example. It may be desirable to use a lightweight material such that a user having the tail stop arrangement 200 on their clothing does not notice an additional weight.

In the example embodiments the channel 304 in the first tail stop 300 is defined in both the first and second part 311, 312. In other embodiments the channel of the first tail stop 300 may be formed exclusively in the first part 311 or the second part 312. For example, the first part 311 may be defined as a simpler flat "lid" for a channel defined in the second part 312.

Similarly the channel 404 and protrusion 406 of the second tail stop are defined, in the example embodiment, by both the first and second part 411, 412. In other embodiments the channel 404 and/or protrusion 406 may be formed exclusively from the first part 411 or the second part 412.

The protrusion 406 may include a chamfered edge 416 to improve the ease of insertion into the channel 304.

In FIG. 1, the first and second tail stops 300, 400 are shown disengaged and separated by a distance of around 25 mm. In FIG. 2, the first tail stop 300 and the second tail stop 400 are in contact, with protrusion 406 of the second tail stop 400 received in the channel 304 of the first tail stop 300, and the box 114 of the first zip tape 102 received in the channel 404 of the second tail stop 400. The face 313 of the first tail stop 300 is in contact with the face 413 of the second tail stop 400.

From the position indicated in FIG. 2, the first tail stop 300 can slide along the second tail stop, guided by the engagement of the protrusion 406 with the channel 304 and the contact between faces 313 and 413. Moving the first tail stop 300 upwards along the second tail stop 400 will insert the insertion pin 116 into the box 114 through the slider 108. The relative movement of the engaged first tail stop 300 and second tail stop 400 may be limited by engagement of the insertion pin 116 in the box 114, and/or by engagement of the protrusion 406 with the stop 305 defining the end of the channel 304. Following the insertion pin 116 being received in the box 114, the slider 108 can be moved up the zip 100 to interdigitate (fasten) the zip 100. The protrusion 406 may be referred to as in an end position when the insertion pin 116 is inserted into the box 114.

When the protrusion 406 reaches the end position, the first and second tail stops 300, 400 may be engaged such that their ends 300*a*, 400*a* lie parallel, but this is not essential.

The channel 304 may include a taper. For example, the channel 304 may narrow towards the end position to limit movement of the protrusion 406 in the z-direction further as the protrusion is moved downward along into the channel 304. In this way, the tail stop arrangement 200 may have generous alignment tolerance when the protrusion 406 is first inserted into the channel 304, and the tolerance may become smaller as the protrusion 406 moves toward the end position.

When after having undone the zip 100, the user can separate the tail stops and disengage the insertion pin 116 from the box 114 by moving the protrusion 406 along the channel 304 away from the end position towards the box 114.

The first tail stop 300 may be configured to be attached to the first zip tape 102 around the box 114 such that the box 114 is not prevented from performing its usual function. The channel 304 in the body 302 may be configured to at least partly receive the box 114, for example. In some embodiments, the first tail stop may be configured such that the box 114 does not stick out from the body 302 and so is less vulnerable to damage.

In an alternative embodiment, the first tail stop 300 is configured to retain the slider 108 on the teeth 106 of the first zip tape 102. The pieces 311 and 312 may clamp around the first zip tape 102 in order to retain the slider 108. The body 302 may comprise a box 114 configured to retain the slider 108 on the teeth 106.

The box 114 may not be required and instead the body 302 of the first tail stop 300 may provide functions of a box 114. The first tail stop 300 may provide a function of a box 114, instead of the box 114, in providing a "stop" for the slider 108 to ensure its correct positioning for the first and second sets of teeth 106 to match up and allow the slider 108 then to slide on the teeth 106 without getting stuck. The first tail stop 300 may provide another function of a box 114, instead of a box 114, by comprising a groove configured to receive the insertion pin 116. The groove may be dimensioned to receive the insertion pin 116 in a snug fit. The groove may be defined in the body 302 above the channel 304—i.e. closer to the slider 108 than the channel 304. The groove may be defined in the face 313 of the first tail stop 300. The first tail stop 300 may provide another function of a box 114, instead of a box 114, by comprising a latch. The first and second tail stops 300, 400 may comprise a latching arrangement, wherein the latch may be configured to latch onto a latch receiving element of the second tail stop 400. The latching arrangement may be configured to retain the first and second tail stops 300, 400 in the x-direction to prevent the tail stops 300, 400 from bursting apart under load. The latching arrangement may be configured to retain the first and second tail stops 300, 400 in the x-direction to prevent the teeth 106 of each zip tape 102, 104 from bursting apart under load—a usual function of a box 114—which may be achieved by preventing the tail stops 300, 400 from bursting apart.

The latch and latch receiving element may be engaged by sliding the protrusion 406 in the channel 304 as described above, thus not adding a level of difficulty to closing the zip 100 for the user. The latch and latch receiving element may be disengaged by sliding the protrusion 406 in the channel 304 as described above, again avoiding making the zip 100 difficult to use.

The pieces 411 and 412 of the second body 402 may be configured to attach to the second zip tape 104 but not affixed to the insertion pin 116 itself. This may leave the insertion pin 116 exposed, allowing it to be pulled into the box 114 when the protrusion 406 slides in the channel 304. As shown, the channel 404 may be configured to receive the insertion pin 116—as with the box 114 above, this may prevent the insertion pin 116 from sticking out from the body 402 in use and thus prevent damage to the insertion pin 116. In addition, all the user needs to feel is the pair of tail stops 300, 400 and possibly the protrusion 406 to identify how to engage the insertion pin 116 and box 114: they do not need to feel for the insertion pin 116 and box 114, so having these elements received in the channels 304, 404 rather than sticking out from the bodies 302, 402 may aid the user.

In an alternative embodiment one or more features of the zip tapes 102, 104 may be integrated with the first tail stop 300 and/or the second tail stop 400. For example, the first tail stop 300 may be formed integrally with the end of the zip tape 102 and comprise an insertion pin 116, and/or the second tail stop 400 may be formed integrally with the second zip tape 400 and comprise a box 114 (as already mentioned above).

In some embodiments the two sets of teeth may be brought into alignment simply by the protrusion 406 being at its end position, enabling a slider 108 to slide successfully on the two sets of teeth 106. The tail stops 300, 400 may be retrofittable to an existing zip 100 having an insertion pin 116 and a box 114, or a zip 100 may be specially manufactured with its own tail stops 300, 400 and zip tapes 102, 104.

Figure 3:
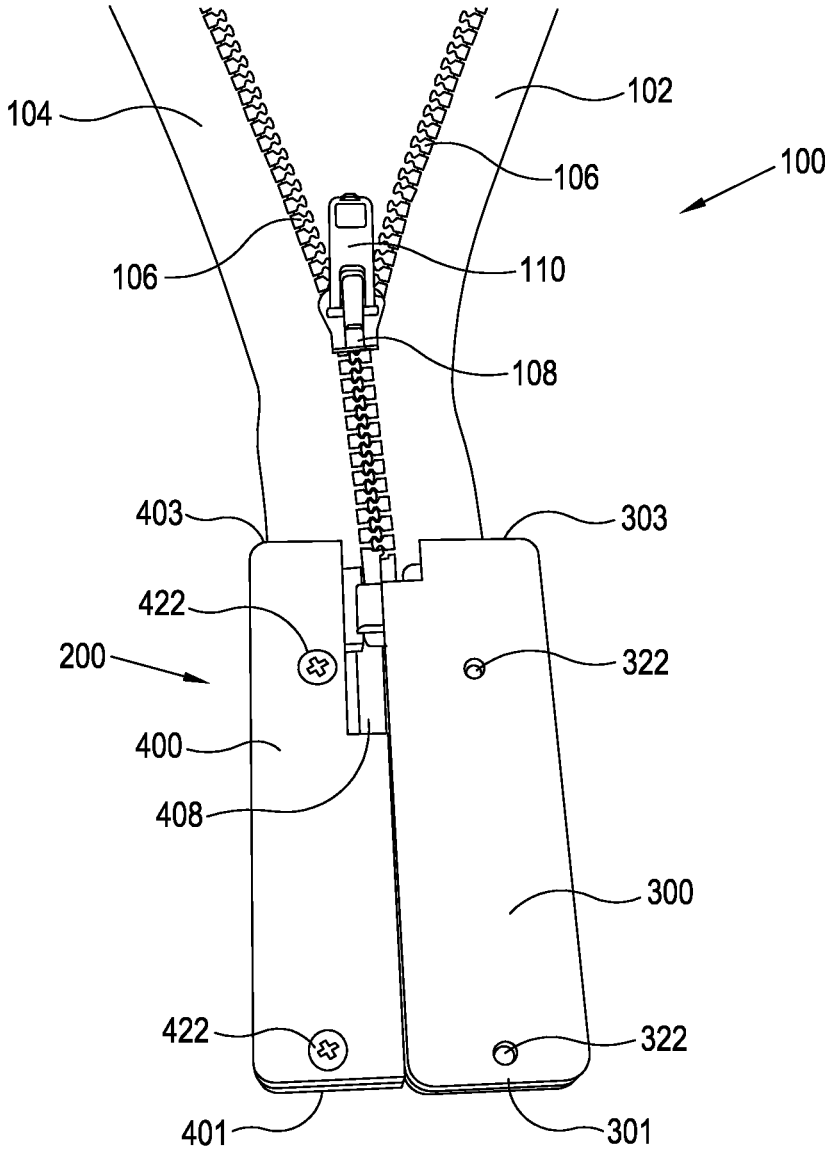
FIG. 3 shows a front view of the tail stop arrangement of FIGS. 1 and 2, with the first tail stop and the second tail stop fully engaged so that the zip is engaged.
Figure 4:
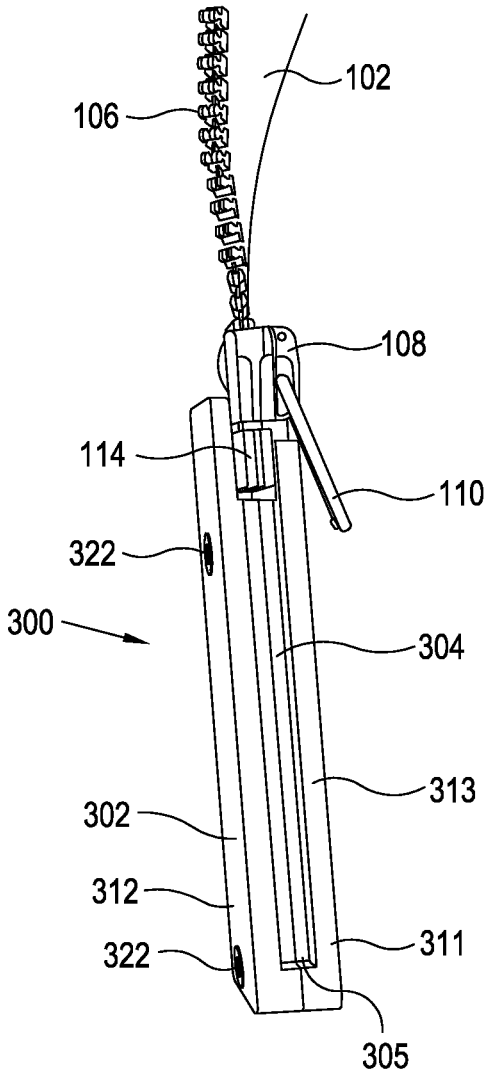
FIG. 4 shows a side view of the first tail stop of FIGS. 1, 2 and 3, attached to a first zip tape.
Figure 5:
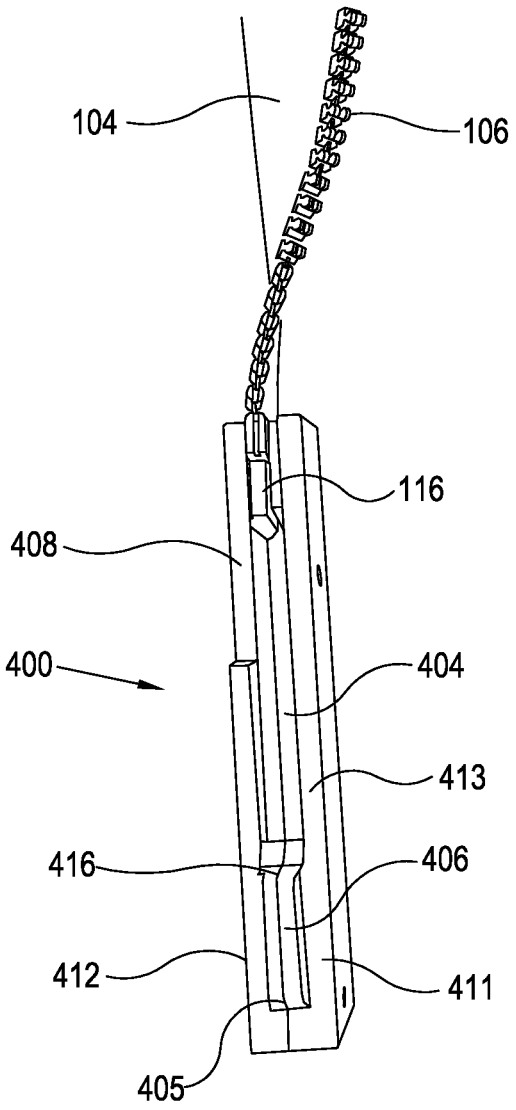
FIG. 5 shows a side view of the second tail stop of FIGS. 1, 2 and 3, attached to a second zip tape.

As shown most clearly in FIG. 3, the second tail stop 400 may comprise a recess 408 configured to receive the slider 108. In addition, the recess 408 may make the tab 110 easier to grasp for a user, with the recess 408 allowing space for the user's fingers to get to the tab 110. The recess 408 may have a length longer than the tab 110, to aid the user in grasping the tab 110.

Figure 11:
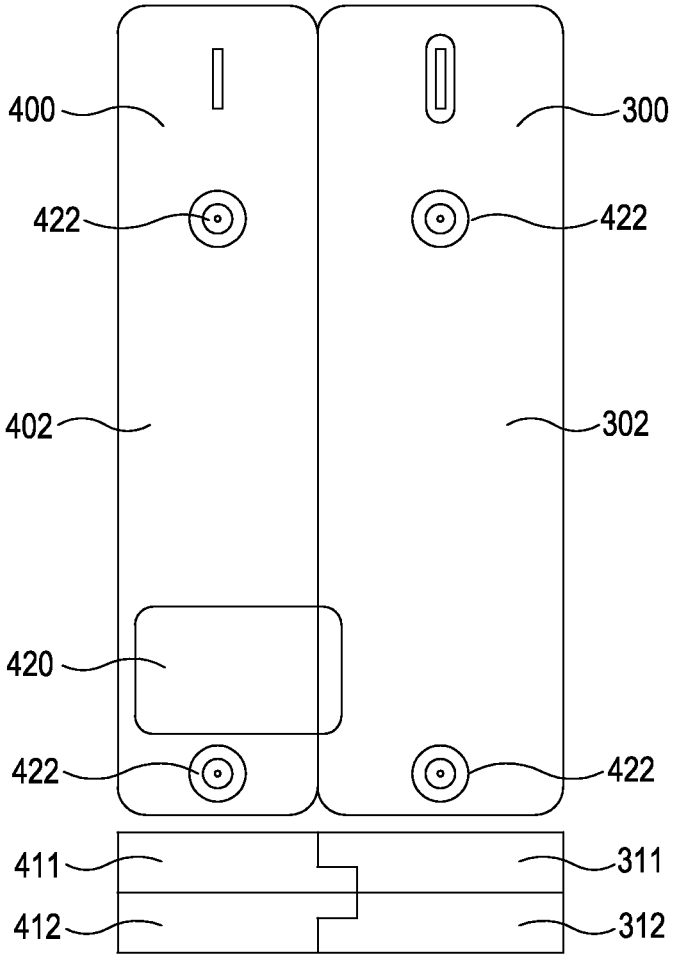
FIG. 11 shows a front and top view of a tail stop arrangement according to a second embodiment, comprising a magnet.

In some embodiments, the second tail stop 400 may comprise a permanent magnet. An example embodiment is schematically illustrated in FIG. 11, comprising a permanent magnet 420, which is clamped between the first part 411 and second part 422 of the second tail stop. The embodiment of FIG. 11 shares the features described with reference to FIGS. 1 to 5, except that the protrusion is defined by a permanent magnet, and at least a portion of the first tail stop 300 comprises a ferromagnetic material, so that the first tail stop 300 and second tail stop 400 are urged together by magnetic force. A magnet is not an essential feature, and it will be appreciated that other positions for the magnet will also work: the magnet could be in the first tail stop 300, and/or a pole piece can be used to couple magnetic flux from the magnet in one tail stop to a ferromagnetic element in the other tail stop. In some examples, both tail stops 300, 400 may include a permanent magnet and the two magnets may attract one another.

Figure 6:
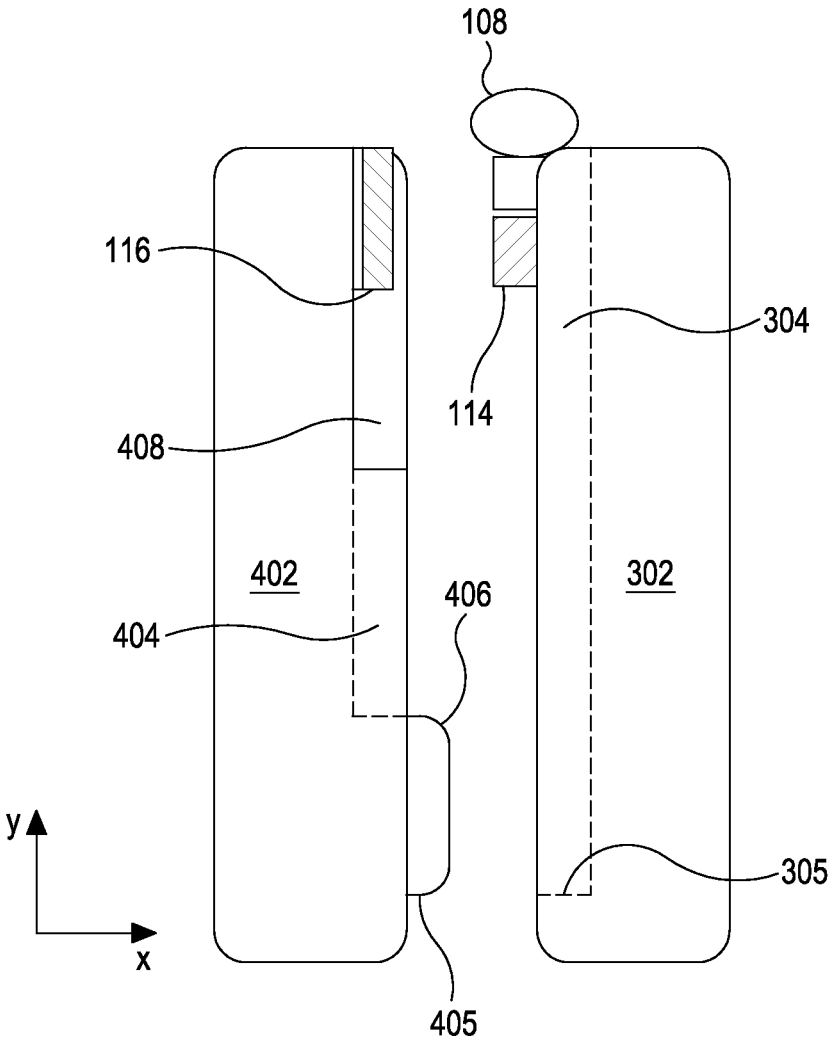
FIGS. 6 to 10 illustrate some step in bringing a first and second tail stop into full engagement.
Figure 7:
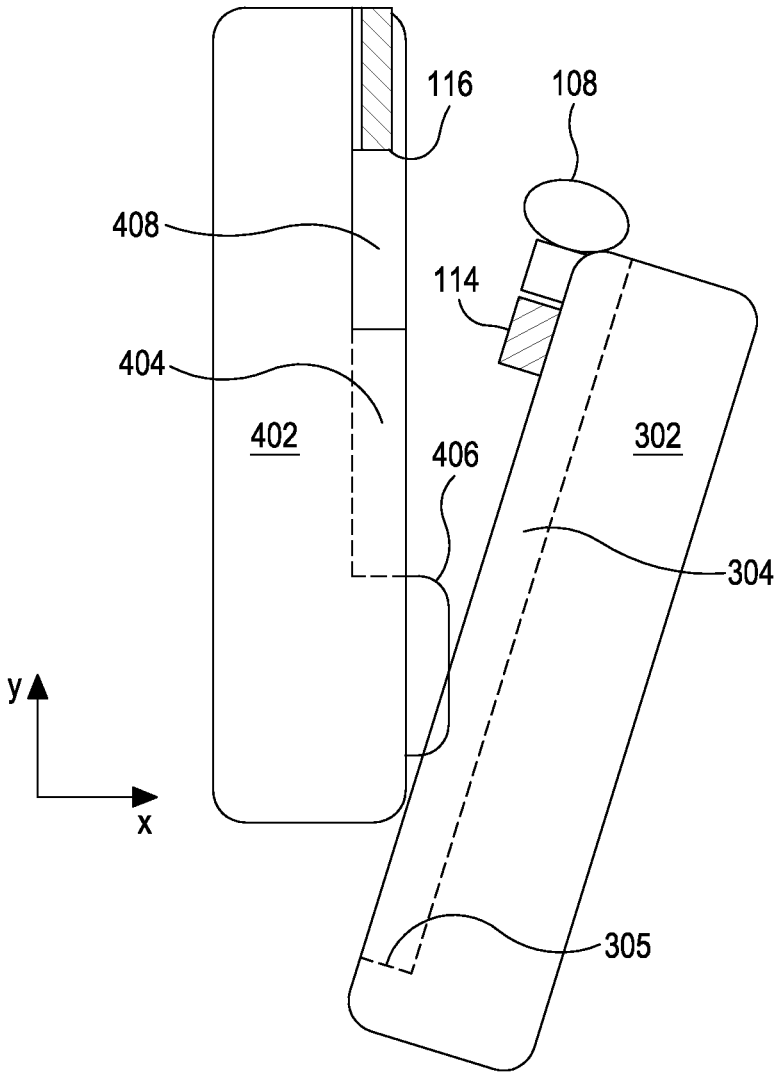
Figure 8:
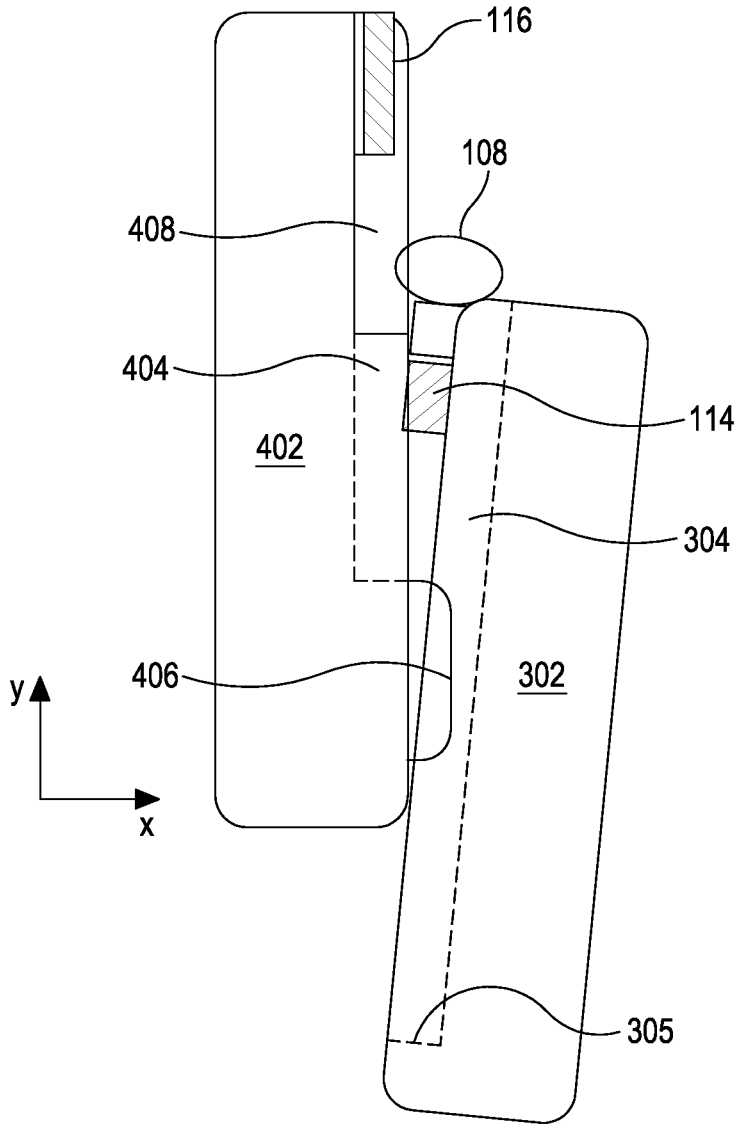
Figure 9:
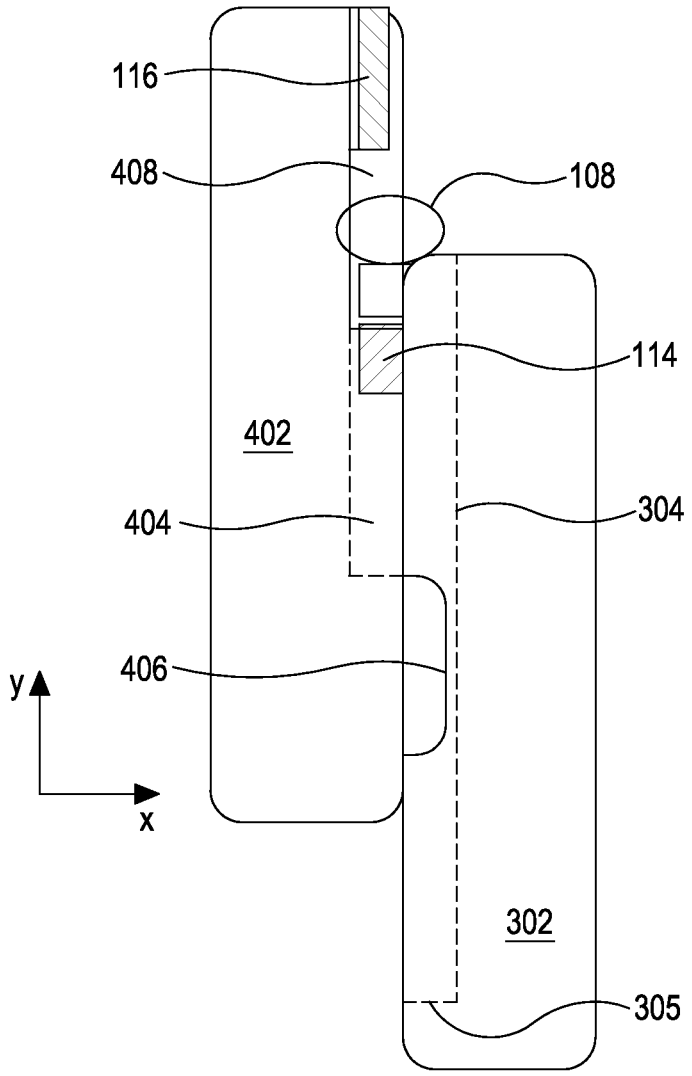
Figure 10:
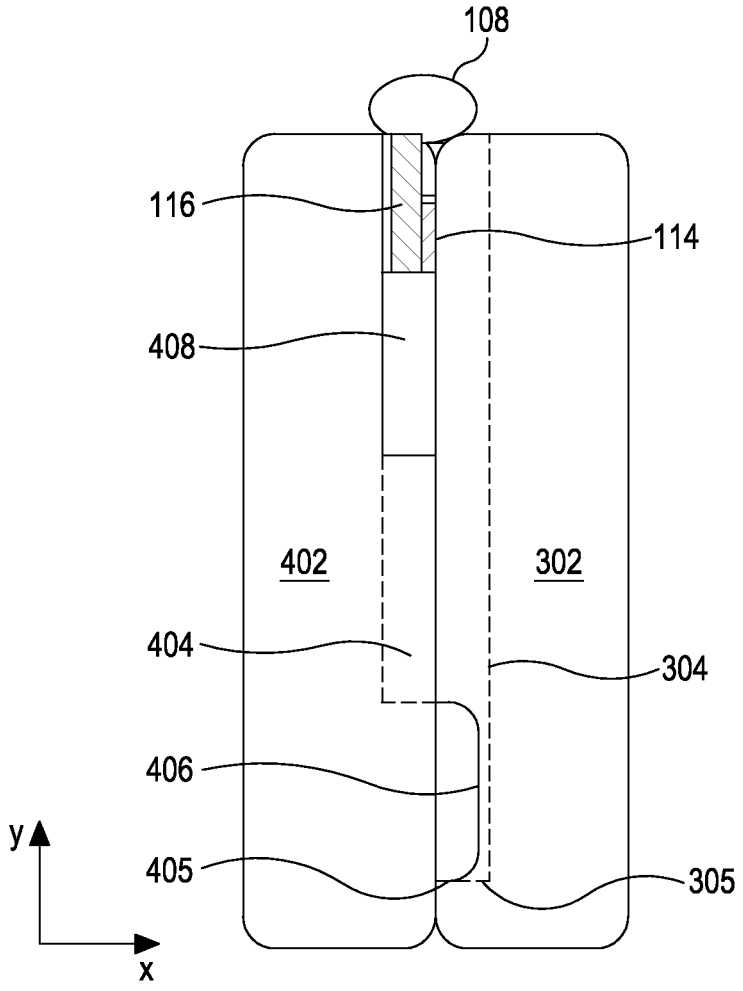

Referring to FIGS. 6 to 10, an example engagement between a first tail stop and second tail stop is illustrated. The features of the tail stops are substantially as described with reference to FIGS. 1 to 5. In FIG. 6, the bodies 302, 402 of the first and second tail stops are separate and not in contact. In FIG. 7 a portion of the protrusion 406 is inserted into the channel 304. This partial insertion of the protrusion 406 into the channel will bring the box 114 into the correct position to be received in the channel 404 by rotation of the body 302 of the first tail portion 300 about the z axis in an anticlockwise direction. This rotation brings the first and second tail stops to the position shown in FIG. 8. Further engagement brings the faces of the bodies 302, 402 into engagement, and the slider 108 is received in the recess 408. Sliding the protrusion downward along the channel in the y direction while keeping the faces of the bodies 302, 402 engaged results in the insertion pin 116 being inserted fully into the box 114, as shown in FIG. 10. The slider 108 can then be moved to fasten the zip.

Although specific examples have been described, these are not intended to limit the scope of the invention, which should be determined with reference to the accompanying claims.

The invention claimed is:

1. A zip comprising:

a first zip tape comprising a first set of teeth and a box;

a second zip tape comprising:

a second set of teeth configured to engage the first set of teeth; and an insertion pin;

a slider arranged on the first set of teeth and configured to slide along the first set of teeth and guide the second set of teeth into engagement with the first set of teeth; and a tail stop arrangement comprising:

a first tail stop comprising a body, a first upper end, and a first lower end, wherein the body comprises a first channel; and a second tail stop comprising a protrusion, a second upper end, and a second lower end, wherein the body has a first longitudinal axis, wherein the first channel extends parallel to the first longitudinal axis, wherein a coordinate system of the tail stop arrangement comprises a y-direction parallel to the first longitudinal axis, an x-direction perpendicular to the first longitudinal axis along which the first channel is open, and a z-direction perpendicular to the first longitudinal axis along which the first channel is closed, wherein the protrusion is configured to be inserted into the first channel in the x-direction to engage the first tail stop and the second tail stop, slide within the first channel in the y-direction when the first tail stop and the second tail stop are engaged, and slide in the first channel towards an end position, wherein when the protrusion is in the end position, the first tail stop and the second tail stop are configured to be aligned by an engagement of the protrusion with the first channel in the x-direction, the y-direction, and the z-direction to enable the zip to be fastened, wherein the first zip tape comprises the first tail stop, wherein the second zip tape comprises the second tail stop, wherein the y-direction is parallel to a direction in which the slider is configured to slide on the first set of teeth, wherein the first tail stop is attached to the first zip tape adjacent the box near the first upper end, wherein the first channel extends away from the box towards the first lower end, wherein the second tail stop is attached to the second zip tape adjacent the insertion pin near the second upper end, wherein the protrusion is arranged near the second lower end, wherein the second tail stop further comprises a second channel parallel to a second longitudinal axis of the second tail stop, wherein the protrusion is arranged in the second channel and is configured to project from the second channel, and wherein the second channel is configured to receive zip elements associated with the first zip tape while in use.

2. The zip of claim 1, wherein the protrusion comprises a chamfered edge configured to assist the engagement.

3. The zip of claim 1, wherein the first channel narrows towards the end position to align the first tail stop and the second tail stop in the z-direction at the end position as the protrusion is moved towards the end position.

4. The zip of claim 1, wherein the first tail stop further comprises a first part and a second part that are configured to be clamped around the first zip tape, and wherein the first part and the second part together define the first channel.

5. The zip of claim 1, wherein the second tail stop further comprises a third part and a fourth part that are configured to be clamped around the second zip tape, and wherein the third part and the fourth part together define the second channel.

6. The zip of claim 5, wherein the third part and the fourth part each comprise a portion of the protrusion.

7. The zip of claim 1, wherein the first tail stop and the second tail stop are formed from polymeric material.

8. The zip of any of claim 1, wherein one of the first tail stop or the second tail stop further comprises a ferromagnetic material, and wherein the other of the first tail stop or the second tail stop further comprises a permanent magnet.

9. The zip of claim 8, wherein the second tail stop further comprises the permanent magnet, and wherein the permanent magnet is arranged on or within the protrusion.

10. The zip of claim 9, wherein the protrusion comprises a chamfered edge, and wherein the permanent magnet is arranged adjacent the chamfered edge.

11. The zip of claim 1, wherein the first tail stop has a first outer surface for grasping by a user, wherein the second tail stop has a second outer surface for grasping by the user, and wherein when the protrusion is at the end position and the tail stops are aligned in the x-direction, the y-direction, and the z-direction, the first outer surface and the second outer surface are configured to be parallel to each other.

12. The zip of claim 1, wherein when the protrusion is in the end position, the insertion pin is configured to be inserted into a groove of the first tail stop or into the box.

13. The zip of claim 1, wherein the second tail stop further comprises a recess that is arranged closer to the second zip tape than the protrusion and that is configured to receive the slider.

14. The zip of claim 13, wherein the slider comprises a tab configured to allow a user to move the slider on the first set of teeth, and wherein the recess has a length longer than a length of the tab.

15. The zip of claim 1, wherein the first tail stop extends a first length from the first zip tape of less than 0.1 meters (m), and wherein the second tail stop extends a second length from the second zip tape of less than 0.1 m.

* * * * *